US010483705B2

(12) United States Patent
Wang et al.

(10) Patent No.: US 10,483,705 B2
(45) Date of Patent: Nov. 19, 2019

(54) ELECTRICAL CONNECTOR AND ELECTRICAL CONNECTION ASSEMBLY

(71) Applicants: TYCO ELECTRONICS (SHANGHAI) CO. LTD., Shanghai (CN); TYCO ELECTRONICS TECHNOLOGY (SIP) LTD., Suzhou (CN)

(72) Inventors: Jifa Wang, Suzhou (CN); Xiao Zhou, Shanghai (CN)

(73) Assignees: Tyco Electronics (Shanghai) Co., Ltd., Shanghai (CN); Tyco Electronics Technology (SIP) Ltd., Suzhou (CN)

( * ) Notice: Subject to any disclaimer, the term of this patent is extended or adjusted under 35 U.S.C. 154(b) by 0 days.

(21) Appl. No.: 15/938,247

(22) Filed: Mar. 28, 2018

(65) Prior Publication Data

US 2018/0287319 A1 Oct. 4, 2018

(30) Foreign Application Priority Data

Mar. 29, 2017 (CN) ..... 2017 2 0322687 U

(51) Int. Cl.
*H01R 27/02* (2006.01)
*H01R 4/70* (2006.01)
(Continued)

(52) U.S. Cl.
CPC ..... *H01R 27/02* (2013.01); *H01R 4/62* (2013.01); *H01R 4/70* (2013.01); *H01R 12/585* (2013.01); *H01R 25/162* (2013.01)

(58) Field of Classification Search
CPC ..... H01R 43/24; H01R 13/405; H01R 27/02; H01R 4/70; H01R 4/62; H01R 12/585; H01R 25/162; Y02E 60/12; H01M 2/206
(Continued)

(56) References Cited

U.S. PATENT DOCUMENTS 5,326,273 A 7/1994 Kamon et al.
2014/0308561 A1* 10/2014 Goesmann ..... H01M 2/206 429/121

FOREIGN PATENT DOCUMENTS

CN 205335452 U 6/2016
DE 102011087038 A1 5/2013

OTHER PUBLICATIONS

Extended European Search Report, dated Aug. 22, 2018, 9 pgs.

* cited by examiner

*Primary Examiner* — Gary F Paumen
(74) *Attorney, Agent, or Firm* — Saxton & Stump LLC

(57) ABSTRACT

The present disclosure provides an electrical connector and an electrical connection assembly. The electrical connector has a first connector, a second connector, and a retainer. The first connector has a first connecting portion and a first protruding end portion that are integrally connected with each other. The second connector has a second connecting portion and a second protruding end portion that are integrally connected with each other. The second connector and the first connector are independently formed elements, respectively. The retainer is integrally interconnected with the first connector and the second connector. The second connecting portion is electrically connected with the first connecting portion. The first protruding end portion is arranged to protrude from the retainer to electrically connect a first mating connector. The second protruding end portion is arranged to protrude from the retainer to electrically connect a second mating connector. The electrical connector of the present disclosure as a modularized assembly may be applied to a plurality of scenarios and thus has extremely high universal flexibility.

7 Claims, 12 Drawing Sheets

(51) Int. Cl.
*H01R 12/58* (2011.01)
*H01R 4/62* (2006.01)
*H01R 25/16* (2006.01)

(58) Field of Classification Search
USPC ..... 439/627, 606
See application file for complete search history.

ELECTRICAL CONNECTOR AND ELECTRICAL CONNECTION ASSEMBLY

FIELD OF THE INVENTION

The present disclosure relates to an electrical connection structure, and more particularly to an electrical connector and electrical connection assembly useful for electrically connecting battery cells.

BACKGROUND OF THE INVENTION

An electrical connector may enable an electrical connection between different electronic components. Fitting and assembling relationships between an electrical connector component and other components directly affect assembling efficiency and connection stability of an entire electrical connection assembly. Particularly in an electrical connection assembly that needs a great number of electrical connectors to implement electrical connections, how to implement convenient assembly and stable connections of the electrical connectors needs special consideration. For example, for an electrical connection assembly applied in battery cells of an electric vehicle, it is important for the long-term healthy developments of electric vehicles how to reduce manufacturing costs of the electrical connection assembly and improve stable electrical connection performance.

SUMMARY OF THE INVENTION

One of the objectives of the present disclosure is to provide an electrical connector and electrical connection assembly having strong universal flexibility, a stable connection, and long service life to overcome the drawbacks of the prior art.

According to a first aspect of the present disclosure, an electrical connector is provided. The electrical connector comprises a first connector, a second connector, and a retainer. The first connector comprises a first connecting portion and a first protruding end portion that are integrally connected with each other. The second connector comprises a second connecting portion and a second protruding end portion that are integrally connected with each other. The second connector and the first connector are independently formed elements, respectively. The retainer is integrally interconnected with the first connector and the second connector. The second connector is electrically connected with the first connecting portion. The first protruding end portion is arranged to protrude from the retainer to electrically connect a first mating connector. The second protruding end portion is arranged to protrude from the retainer to electrically connect a second mating connector.

Preferably, the first connector and the second connector are made of different metal materials. The second connecting portion is connected to the first connecting portion by welding.

Preferably, the first connector is a whole unit of aluminum material for electrically connecting the first mating connector made of the aluminum material; and/or the second connector is a whole unit of copper material for electrically connecting the second mating connector made of the copper material.

Preferably, the first connector further comprises a connecting body. The first connecting portion and the first protruding end portion are arranged at two ends of the connecting body, respectively. More preferably, one end of at least part of the connecting body is arranged to protrude from the first protruding end portion along a radial direction of the first connector. A supporting step is arranged between the first protruding end portion and the connecting body. The supporting step may be arranged for supporting the first mating connector.

Preferably, the second connecting portion is provided with a connecting hole. The connecting hole is enclosed by a hole wall. The first connecting portion is inserted into the connecting hole and is in electrical contact connection with at least one of the hole wall, an upper surface of the second connecting portion, and a lower surface of the second connecting portion. More preferably, a free end of the first connecting portion is provided with a blocking wall. The blocking wall protrudes and extends along a radial direction of the first connecting portion and is arranged to be block-fittable with the second connecting portion along an axial direction of the first connector. More preferably, the blocking wall is integrally welded to the second connecting portion. Additionally or alternatively, a sidewall of the second connecting portion is provided with an extension portion protruding along a radial direction of the connecting hole. The extension portion is arranged to extend along a circumferential direction of the connecting hole and protrude from a side wall of the second connecting portion.

Preferably, the second protruding end portion is a press-fit end to be in press-fittable electrical connection with the second mating connector.

Preferably, the first connecting portion and the second connecting portion are arranged to contact to form a joint edge. The retainer is arranged to wrap up the joint edge.

Preferably, the retainer is arranged to wrap up the first connecting portion and the second connecting portion.

Preferably, the retainer is a water-tight sealed structure.

Preferably, the retainer is an injection-molded unit, a silicone cured whole unit or a rubber whole unit.

Preferably, the retainer, the first connector, and the second connector are configured into an insert-injection-molded whole unit; wherein the first connecting portion of the first connector and the second connecting portion of the second connector are inserts.

Preferably, the electrical connector is applied in a battery pack to enable electrical connections with a bus-bar and a circuit board. The first protruding end portion may be electrically connected to the bus-bar. The second protruding end portion may be electrically connected to the circuit board.

According to a second aspect of the present disclosure, an electrical connection assembly is further provided. The electrical connection assembly comprises a first mating connector, a second mating connector, and the electrical connector according to any of the items mentioned above. The first mating connector is electrically connected to the first protruding end portion of the first connector. The second mating connector is electrically connected to the second protruding end portion of the second connector.

Preferably, the first mating connector is a bus-bar. The bus-bar is made of the same metal material as that of the first protruding end portion and is integrally welded to the first protruding end portion.

Preferably, the second protruding end has the same metal material as that of the second mating connector and is in press-fit electrical connection with the second mating connector.

Preferably, the second mating connector is provided with a mounting hole. A mounting post is protrudingly provided on the retainer. The mounting post is configured to extend in the same direction as the second protruding end portion and to be spaced apart therefrom. At least part of the mounting post is accommodated in the mounting hole.

Preferably, the second mating connector is a circuit board.

Preferably, the electrical connection assembly further comprises a support frame. The electrical connector is arranged on the support frame. In a more preferred embodiment, the support frame comprises a groove front end wall, groove side walls, a groove rear end wall, and a groove bottom wall. The groove front end wall, the groove side walls, and the groove rear end wall enclose a mounting groove. The retainer is accommodated in the mounting groove. Additionally or alternatively, at least one of the groove side walls is provided with a backstop arm. The backstop arm is configured to protrude and extend into the mounting groove and to be block-fittable with the retainer. Additionally or alternatively, one or two side walls of the retainer are provided with a blocking step. The blocking step is configured to be block-fittable with the backstop arm. Additionally or alternatively, the groove front end wall and the groove rear end wall are arranged apart along a longitudinal direction of the retainer. The distance between the groove rear end wall and the backstop arm is greater than or equal to a longitudinal length of the retainer. Additionally or alternatively, the support frame further comprises a supporting cantilever, a free end of the supporting cantilever being provided with a return-blocking portion. The return-blocking portion and the groove front end wall are arranged apart and may be block-fitted with the retainer, respectively. Additionally or alternatively, the supporting cantilever is configured to continuously extend from the groove rear end wall and to be spaced from the groove bottom wall. The return-blocking portion is protrudingly arranged on the supporting cantilever.

In another more preferred embodiment, the first mating connector is provided on the support frame. The first mating connector is electrically connected to the first protruding end portion of the first connector and may be used to electrically connect a battery cell.

In yet another more preferred embodiment, the second mating connector is provided on the support frame. The second mating connector is electrically connected to the second protruding end portion of the second connector.

Compared with the prior art, the electrical connector of the present disclosure, as a modularized subassembly, may be applied to various scenarios, and has very high universal flexibility, by selecting the number and the mating position of the electrical connector as needed. Moreover, the electrical connector is not required to be pre-designed to pre-fit with other mating structures, which reduces difficulty in the manufacturing and design, and thereby saves manufacturing costs. Particularly, when a plurality of the electrical connectors are required to be simultaneously and integrally assembled with a mating structure, adopting the individual modularized electrical connectors may prevent the accumulation of assembly tolerance from greatly increasing the difficulty in assembling, and protect the overall structure and the electrical connection stability from damages caused by the stress generated from assembling the multiple electrical connectors. The retainer may not only enhance firm and stable electrical connection performance between the first connector and the second connector, but also enable the electrical connectors to maintain firmly integral. In particular, when the first connector and the second connector of different metals are connected, the retainer may prevent the connecting portions of the first connector and the second connector from electrochemical corrosion, thereby greatly prolonging the service life.

DETAILED DESCRIPTION OF EMBODIMENTS

Hereinafter, the present disclosure will be described in detail with reference to the accompanying drawings:

Embodiment 1

With reference to FIGS. 1 to 4, an electrical connector 101 is provided by the present disclosure. The electrical connector 101 may be applied in a battery module (not shown) and may be electrically connected to a bus-bar and a circuit board which embody a connector, respectively. The electrical connector 101 comprises a first connector 10 and a second connector 30 in contact electrical connection with each other, and a retainer 50 that seals and wraps up the first connector 10 and the second connector 30.

Figure 5:
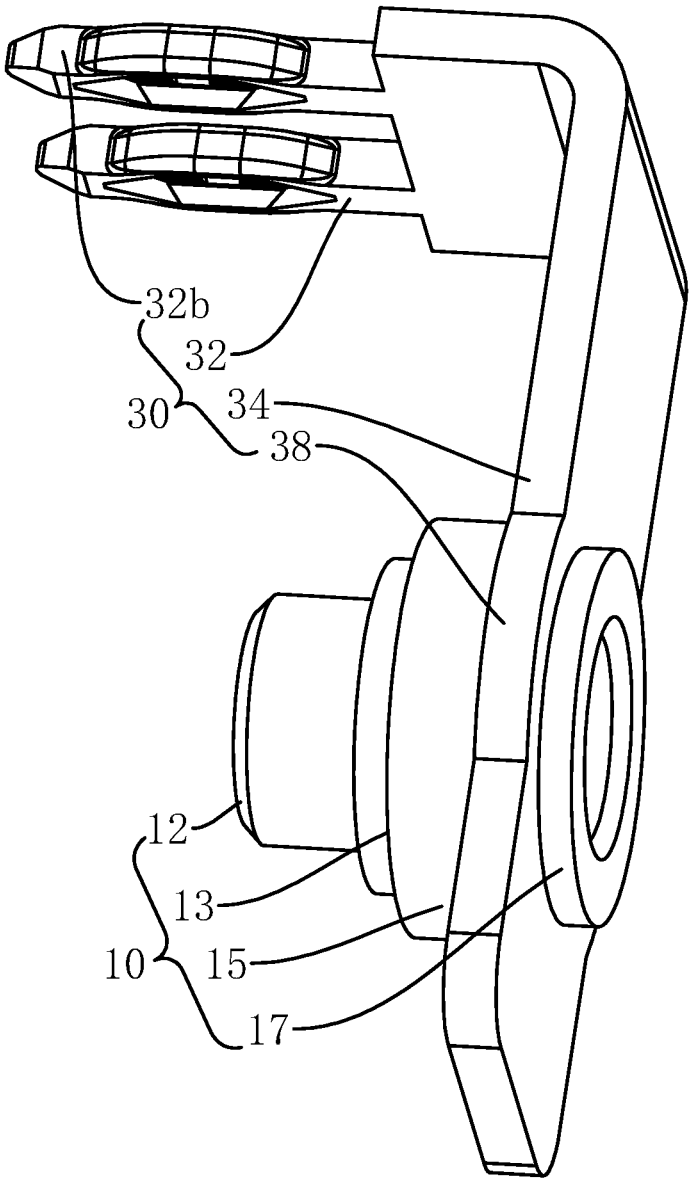
FIG. 5 is a structural diagram of the first connector integrally connected with the second connector in FIG. 1.
Figure 6:
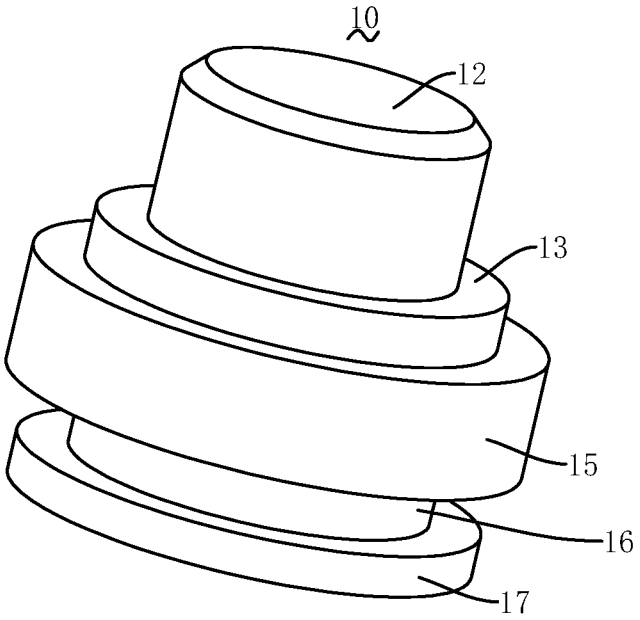
FIG. 6 is a structural diagram of the first connector in FIG. 1.

Along with reference to FIGS. 5 and 6, the first protruding end portion 12 is arranged to protrude from the retainer 50. The first protruding end portion 12 is arranged for electrically connecting a first mating connector 60 as described infra. The specific shape and structure of the first protruding end portion 12 are only required to meet corresponding electrical connection needs. In this embodiment, the first protruding end portion 12 has a radial size smaller than that of a connecting body 15. The first protruding end portion 12 and the connecting body 15 form a supporting step 13. The first protruding end portion 12 may be inserted into a connecting through-hole 68 of the first mating connector 60 and connected to the first mating connector 60. Specifically, the first protruding end portion 12 may be integrally welded to the first mating connector 60. The supporting step 13 is arranged for supporting the first mating connector 60. In other words, when the first protruding end portion 12 is inserted into a corresponding connecting through-hole 68, the supporting step 13 protrudes from a hole wall of the connecting through-hole 68 to support the first mating connector 60. The specific shape and size of the first protruding end portion 12 are only required to enable a connection. In this embodiment, to facilitate insertion, the first protruding end portion 12 is cylindrically-shaped. In this embodiment, the collecting body 15 is also cylindrically-shaped. Correspondingly, to provide a firm and even support for the first mating connector 60, the supporting step 13 is an annular step. In other words, the supporting step 13 extends around one end of the first connector 10 into a whole circle.

A first connecting portion 16 is connected to the connecting body 15. The first connecting portion 16 is in contact electrical connection with the second connector 30. The specific shape and structure of the first connecting portion 16 are only required to achieve an electrical connection. In this embodiment, to enhance firm connection performance between the first connector 10 and the second connector 30, the first connecting portion 16 is connected to the second connector 30 by riveting. Specifically, the first connecting portion 16 is inserted into a connecting hole 36 of the second connector 30. A free end of the first connecting portion 16 is provided with a blocking wall 17 that protrudes. The blocking wall 17 may be arranged to be block-fitted with a second connecting portion 64. Further, the blocking wall 17 is a riveting structure. The blocking wall 17 is arranged to extend along a radial direction of the connecting hole 36 and may be in contact connection with a bottom face 30*a* of the second connector 30. To enhance evenly and firmly retaining performance, the blocking wall 17 is arranged to encircle the connecting hole 36 along its circumferential direction. The first connecting portion 16 may be provided to contact with a hole wall of the connecting hole 36. To further enhance the firm connection performance between the first connector 10 and the second connector 30, the first connector 10 is connected to the second connector 30 by welding. Specifically, the blocking wall 17 is riveted to and then laser welded integrally to the bottom face 30*a* of the second connector 30.

The specific material and various components of the first connector 10 are only required to achieve a corresponding electrical connection. To facilitate a connection with a corresponding part, the first connector 10 utilizes the same metal material structure as that of the first mating connector 60. Specifically, in this embodiment, the first connector 10 is an aluminum structure. To facilitate manufacturing and to enhance the stable performance, the first connector 10 is a whole unit. The first connector 10 as a whole extends axially into a columnar shape.

Figure 7:
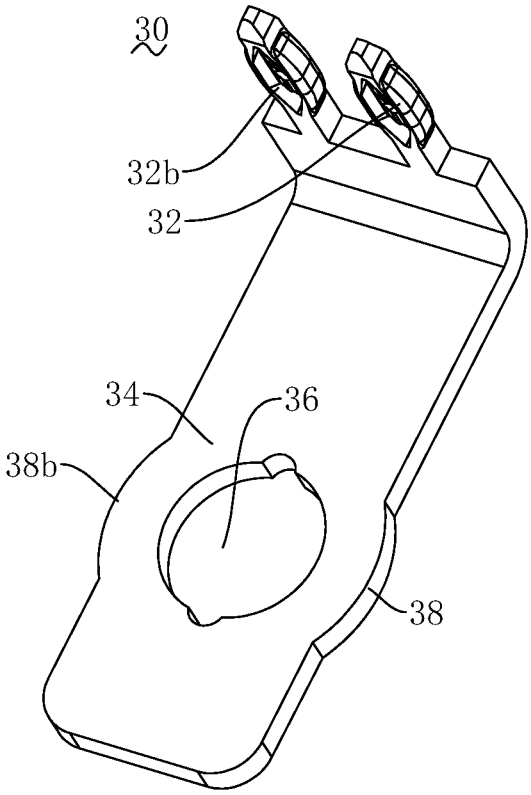
FIG. 7 is a structural diagram of the second connector in FIG. 1.

Along with reference to FIG. 7, the second connector 30 is in contact electrical connection with the first connector 10. The second connector 30 comprises a second protruding end portion 32. The second protruding end portion 32 is arranged to protrude from the retainer 50. The second protruding end portion 32 may be arranged to electrically connect a second mating connector 70 as will be described infra. The specific shape and configuration of the second protruding end portion 32 are only required to achieve the corresponding electrical connection. In this embodiment, to enhance the efficiency of assembling the second connector 30 and the second mating connector 70 and to enhance the stable electrical connection performance, the second protruding end portion 32 is a press-fit terminal. In other words, the second protruding end portion 32 is in press-fit electrical connection with the second mating connector 70. The specific number of the second protruding end portion 32 may be selected as needed. In this embodiment, a pair of the second protruding end portions 32, 32*b* are arranged to be in press-fit electrical connection with the second mating connector 70, respectively and be spaced from each other.

The second connector 30 further comprises a second connecting portion 34. The second connecting portion 34 is arranged for supporting the second protruding end portion 32. The second connecting portion 34 is electrically connected to the first connector 10. Specifically, the second connecting portion 34 is provided with a connecting hole 36. The connecting hole 36 may be a through-hole or a blind hole. In this embodiment, the connecting hole 36 is a round through-hole. To enhance the mechanical strength of the second connecting portion 34, extension portions 38, 38*b* are provided at two sidewalls of the second connecting portion 34. The extension portions 38, 38*b* are arranged to protrude around the connecting hole 36. In this embodiment, the second connecting portion 34 is substantially L-plate shaped. The second protruding end portion 32 and the first protruding end portion 12 are arranged to extend and protrude in the same direction and to be spaced from each other.

The connecting hole 36 is enclosed by a hole wall. The hole wall may be in contact electrical connection with the first connecting portion 16 of the first connector 30. Of course, to enhance the electrical connection performance, an upper and/or lower surface of the second connecting portion 34 are/is in contact electrical connection with the second connecting portion 16. To facilitate assembling, a notch (not labeled in the figure) is provided on the hole wall. In this embodiment, a pair of notches are provided to directly face each other along a length direction of the second connecting portion 34.

To facilitate manufacturing and enhance the mechanical strength, the second connector 30 is a whole unit. The specific material of the second connector 30 is only required to meet corresponding electrical connection requirements. In this embodiment, to facilitate an electrical connection with the second mating connector 70, the second connector 30 is a structure of a second metal material. Specifically, the second connector 30 is made of a metallic copper material identical to a copper foil of the second matching connector 70.

To enhance sealed electrical connection performance, the first connecting portion 16 of the first connector 10 is arranged to contact the second connecting portion 34 of the second connector 30, and form joint edges 25, 25*b*, and 25*c*. The joint edges 25, 25*b*, 25*c* refer to borderlines where the two connecting portions in contact start to separate. To enhance water-tightness sealing and anti-corrosion performance of the joint edges 25, 25*b*, 25*c*, the retainer 50 is arranged to wrap up the joint edges 25, 25*b*, 25*c*. In this embodiment, the three joint edges 25, 25*b*, and 25*c* enclose into a groove shape, wherein the first connecting portion 16 is arranged to contact the second connecting portion 34 in a top-bottom direction to form the joint edges 25, 25*c* in the top-bottom direction. The hole walls circumferentially located enclosing the connecting through-hole 43 contact part of the first connecting portion 16 to form the joint edge 25*b*.

The retainer 50 is arranged for at least sealing the connecting portions of the first connector 10 and the second connector 30. In this embodiment, the retainer 50 wraps up the connecting through-hole 34 between the first protruding end portion 12 and the second connector 30. The retainer 50 is a water-tightness sealed structure, which may prevent moisture from contacting the connecting portions of the first connector 10 and the second connector 30 so that electrochemical corrosion may be avoided. Specifically, the protection performance of the retainer 50 is particularly optimum in the case that the first connector 10 and the second connector 30 are made of different metal materials such that they are susceptible to increased electrochemical corrosion due to a connection between different metals.

The specific material and configuration of the retainer 50 are only required to meet corresponding sealing and retaining requirements. To facilitate manufacturing and easily obtain a preset shape and achieve better sealing and protection performance, the retainer 50 is an injection-molded component. Further, the retainer 50, the first connector 10, and the second connector 30 are together an insert-injection-molded whole unit, wherein the connecting portions of the first connector 10 and the second connector 30 are inserts (i.e., inlays). In other words, the connecting portions of the first connector 10 and the second connector 30 are pre-embedded in a mold, and then the retainer 50 for sealing and wrapping the connecting portions of the first connector 10 and the second connector 30 is formed by injection-molding. Alternatively, the retainer 50 may also be a silicone cured structure. Or, the retainer 50 may also be a structure such as a rubber cured structure or the like that may seal and retain the connecting portions of the first connector 10 and the second connector 30. The specific shape of the retainer 50 is only required to meet corresponding application requirements. In this embodiment, the retainer 50 is substantially rectangular block-shaped. To facilitate being firmly mounted onto a corresponding mounting structure (for example, the support frame 80 as described infra), a limit part 52 is provided at two side walls of the retainer 50. In this embodiment, the limit part 52 is step-shaped. Of course, depending on different applications, the limit part 52 may also be a retaining structure such as a snap-joint, etc.

Embodiment 2

Figure 8:
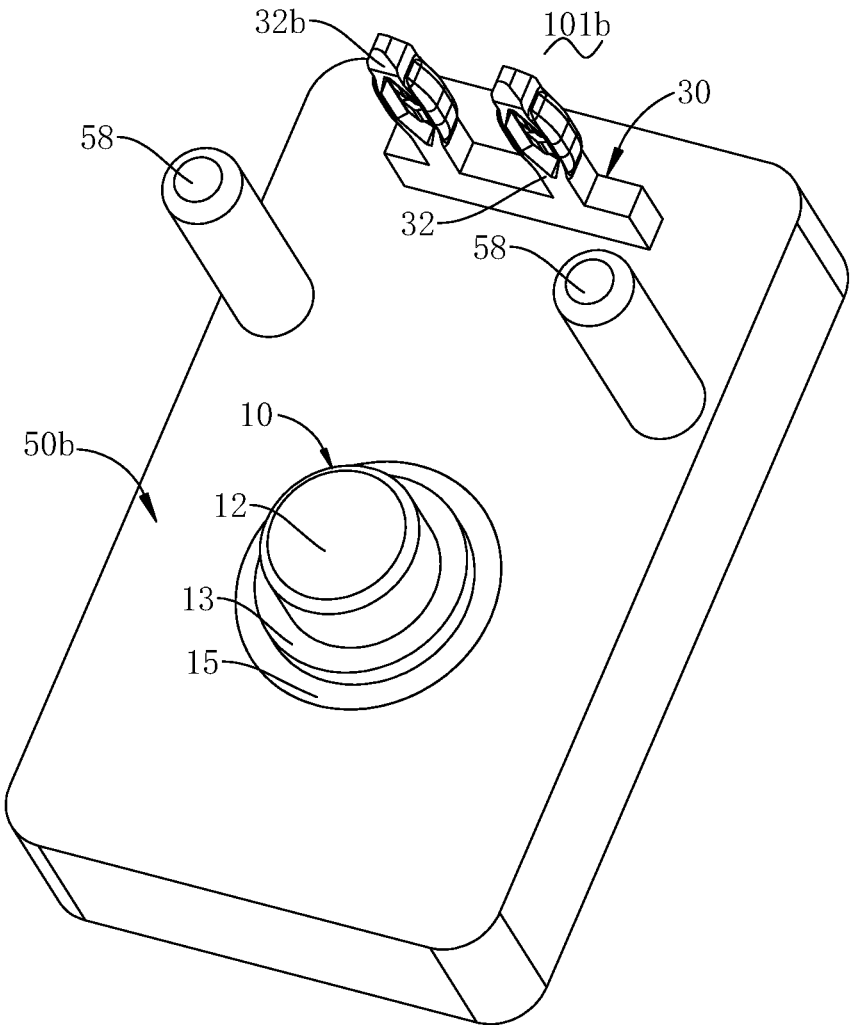
FIG. 8 is a structural diagram of another embodiment of the electrical connector provided by the present disclosure.

With reference to FIG. 8, as a variation of Embodiment 1, the present disclosure further provides another electrical connector 101*b*. Different from Embodiment 1, the electrical connector 101*b* comprises a retainer 50*b* different from the retainer 50 described in Embodiment 1.

The specific shape of the retainer 50*b* may be selected according to needs. In this embodiment, the retainer 50*b* body is substantially rectangular block-shaped. To facilitate connecting the entire electrical connector 101*b* with the second mating connector 70 as will be described infra, the retainer 50*b* further comprises a mounting post 58. The mounting post 58 is protrudingly provided on a retaining body 54. The mounting post 58 may be inserted into a mounting hole 74 of the second mating connector 70 to thereby provide support for firmly, mechanically, and integrally connecting the electrical connector 101*b* with the second mating connector 70. To facilitate assembling, the mounting post 58 protrudes in the same direction as the first protruding end portions 32, 32*b* of the second connector 30. To further facilitate assembling, the mounting post 58 is protrudingly arranged relative to the first protruding end portions 32, 32*b*, such that the electrical connector 101*b* can be pre-assembled onto the second mating connector 70. Then, the first protruding end portions 32, 32*b* are press-fitted into a mating hole 72 on the second mating connector 70 as needed. In this embodiment, the mounting post 58 and the retaining body 54 are together an injection-molded whole unit. The specific shape and configuration of the mounting post 58 are only required to satisfy connection and support requirements. To facilitate insertion, the mounting post 58 is cylindrically shaped. To provide a corresponding guide such that the first protruding end portions 32, 32*b* of the second connector 30 can be accurately press-fitted into the corresponding mating hole 72 of the second mating connector 70, a pair of the mounting posts 58, 58*b* are provided separately, thereby avoiding deflection of the electrical connector 101*b*. The configuration of the mounting posts 58 may save other support structures, such as the support 80 as will be described infra.

Embodiment 3

Figure 9:
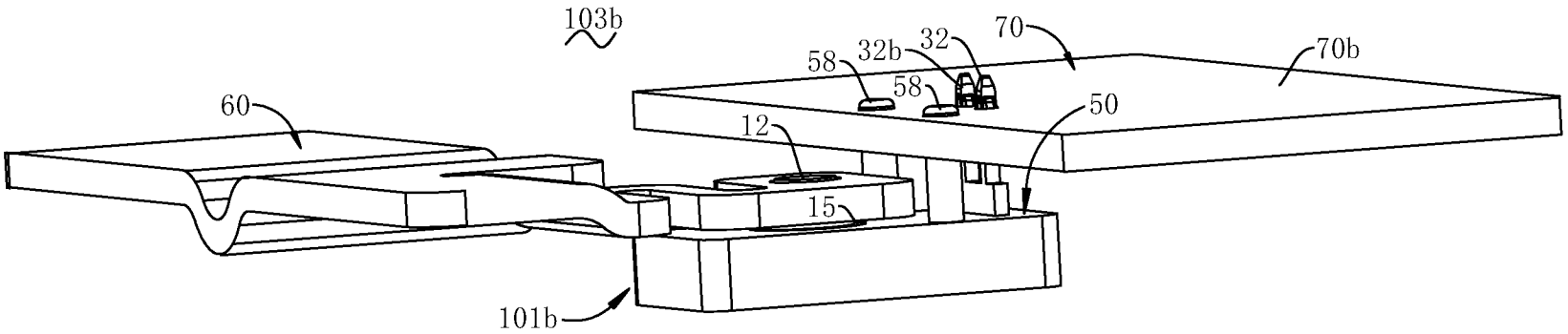
FIG. 9 is a structural diagram of an electrical connection assembly provided by the present disclosure, wherein the electrical connection assembly comprises the electrical connector shown in FIG. 8.

With reference to FIG. 9, the present disclosure provides an electrical connection assembly 103*b*. The electrical connection assembly 103*b* comprises a first mating connector 60, a second mating connector 70, and the electrical connector 101 described in Embodiment 1 or the electrical connector 101*b* described in Embodiment 2. In this embodiment, the electrical connection assembly 103*b* comprises the electrical connector 101*b* as described in Embodiment 2. Correspondingly, the first connector 10 is electrically connected to the first mating connector 60. The second connector 30 is electrically connected to the second mating connector 70. When assembling, the mounting post 58 is inserted into the mounting hole 74 of the second mating connector 70 described below to enhance the performance of firmly maintaining integral.

Figure 10:
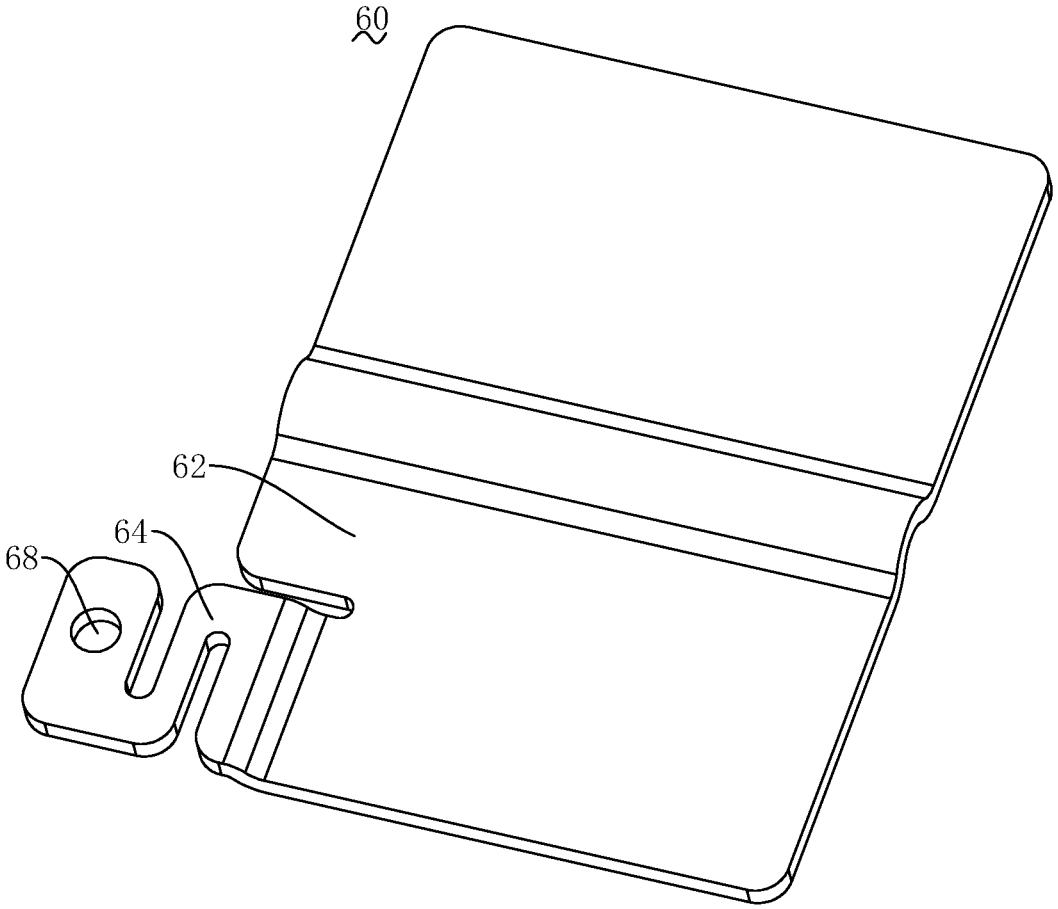
FIG. 10 is a structural diagram of the first mating connector shown in FIG. 9.

With reference to FIG. 10 together, the first mating connector 60 is arranged for electrically connecting the first connector 10 and a battery cell (not shown). The first mating connector 60 is only required to enable a corresponding electrical connection. In this embodiment, to enhance large-current transmission performance, the first mating connector 60 is a bus-bar. The specific shape and specification of the first mating connector 60 may be selected according to application needs. In this embodiment, the first mating connector 60 comprises a mating body 62 and a connecting arm 64. The mating body 62 is substantially rectangular plate-shaped. The mating body 62 is arranged for electrically connecting to the battery cell. To sufficiently utilize space and facilitate an electrical connection, the connecting arm 64 is arranged to protrude from the mating body 62. To enhance anti-vibration performance of the connecting arm 64, the connecting arm 64 is an elastically deformable structure. Specifically, the connecting arm 64 extends in an "S" shape. In other words, a groove is provided at two sides of the connecting arm 64, respectively. The connecting arm 64 and the mating body 62 are arranged to extend substantially in the same plane. The material of the first mating connector 60 is only required to enable a corresponding electrical connection. In this embodiment, the first mating connector 60 is an aluminum structure. Specifically, the first mating connector 60 is formed into a whole unit using an aluminum plate. A connecting through-hole 68 is provided on the connecting arm 64. The connecting through-hole 68 is arranged for receiving the first protruding end portion 12. In this embodiment, the connecting through-hole 68 is a through-hole for welding. In other words, when the first protruding end portion 12 is inserted into the connecting through-hole 68, the first mating connector 60 is integrally connected with the first protruding end portion 21 by welding.

Figure 11:
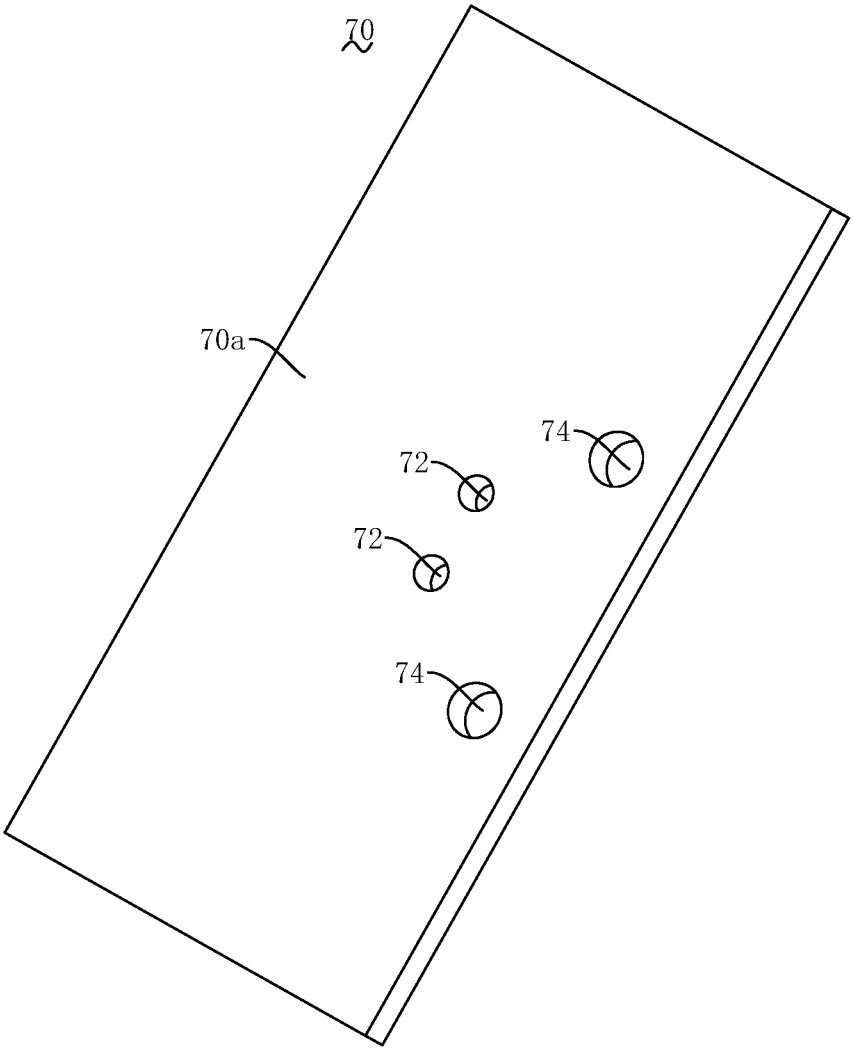
FIG. 11 is a structural diagram of the second mating connector shown in FIG. 9.

With reference to FIG. 11 together, the second mating connector 70 is connected to the second protruding end portion 32. In this embodiment, to facilitate transmission of electrical signals, the second mating connector 70 is a printed circuit board (PCB). The second mating connector 70 may be arranged for carrying a corresponding electronic component (not shown in the figure) and may also be arranged for transmitting corresponding electrical signals and current, etc. Depending on different application needs, corresponding temperature, current, and voltage parameters of the battery cell may also be obtained by arranging a temperature sensor, a current detection component, and a voltage detection component at the second mating connector 70. To enable a corresponding mating connection, a mating hole 72 is provided on the second mating connector 70. The mating hole 72 is arranged for connecting the second protruding end portion 32. A mounting hole 74 is provided on the second mating connector 70. The mounting hole 74 is arranged for receiving the mounting post 58. The mounting hole 74 may be a blind hole or a through-hole, as long as its depth and aperture enable a connection to the mounting post 58. In this embodiment, to achieve larger movement space, the mounting hole 74 is a through-hole. The second mating connector 70 comprises an element face 70*a* and a welding face 70*b* which are oppositely provided. When the second mating connector 70 is connected to the second connector 30, the element face 70*a* is provided to directly face the retaining body 10. The second protruding end portion 32 extends from the element face 70*a* side to a copper foil of the welding face 70*b* to be electrically connected by welding.

Embodiment 4

Figure 12:
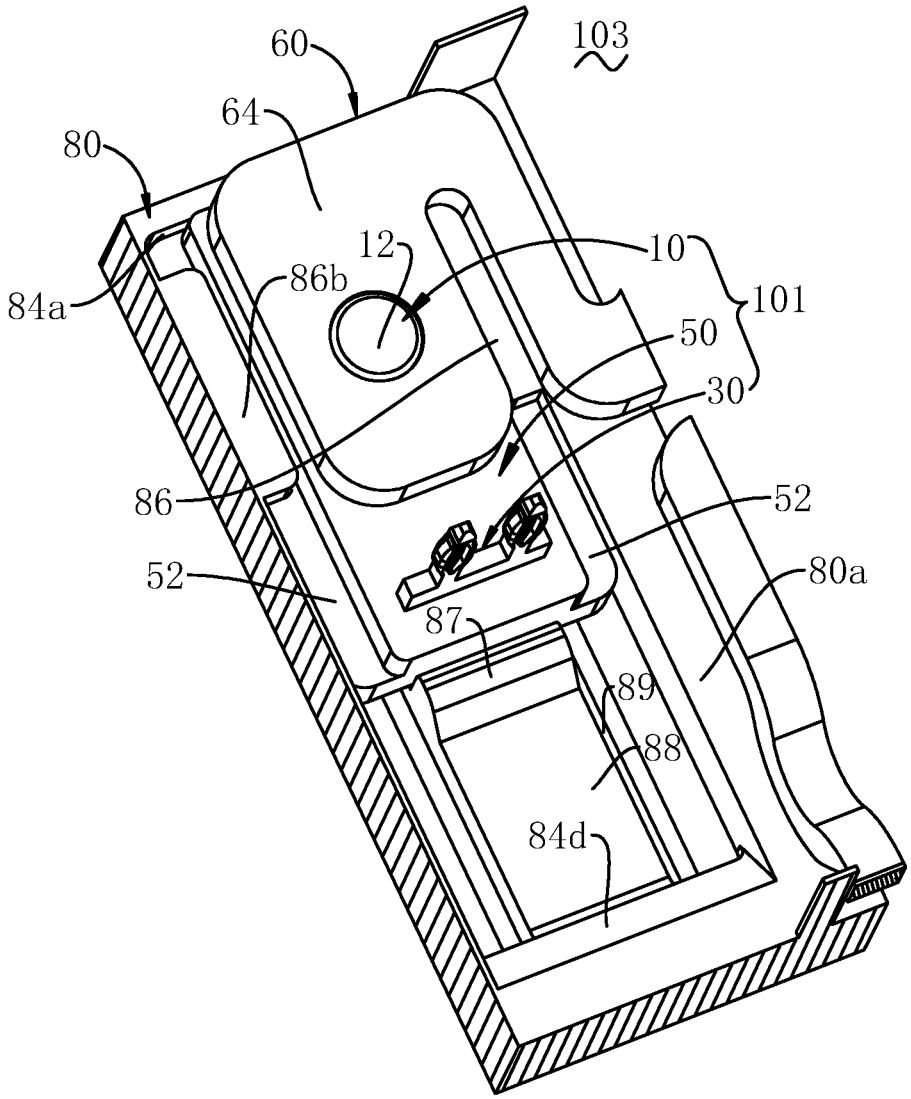
FIG. 12 is a stereoscopic partial sectional view of an electrical connection assembly provided by the present disclosure, wherein the electrical connection assembly comprises the electrical connector shown in FIG. 1.

With reference to FIG. 12, the present disclosure further provides an electrical connection assembly 103. To facilitate arranging other mating components to enhance universal performance, the electrical connection assembly 103 may further comprise a support frame 80. The support frame 80 may be arranged for supporting the electrical connector 101 (or 101*b*). Of course, as needed, the support frame 80 may also support the first mating connector 60 and/or the second mating connector 70. The specific shape and structure of the support frame 80 are only required to satisfy corresponding support needs. In this embodiment, the support frame 80 is a lead frame.

Figure 13:
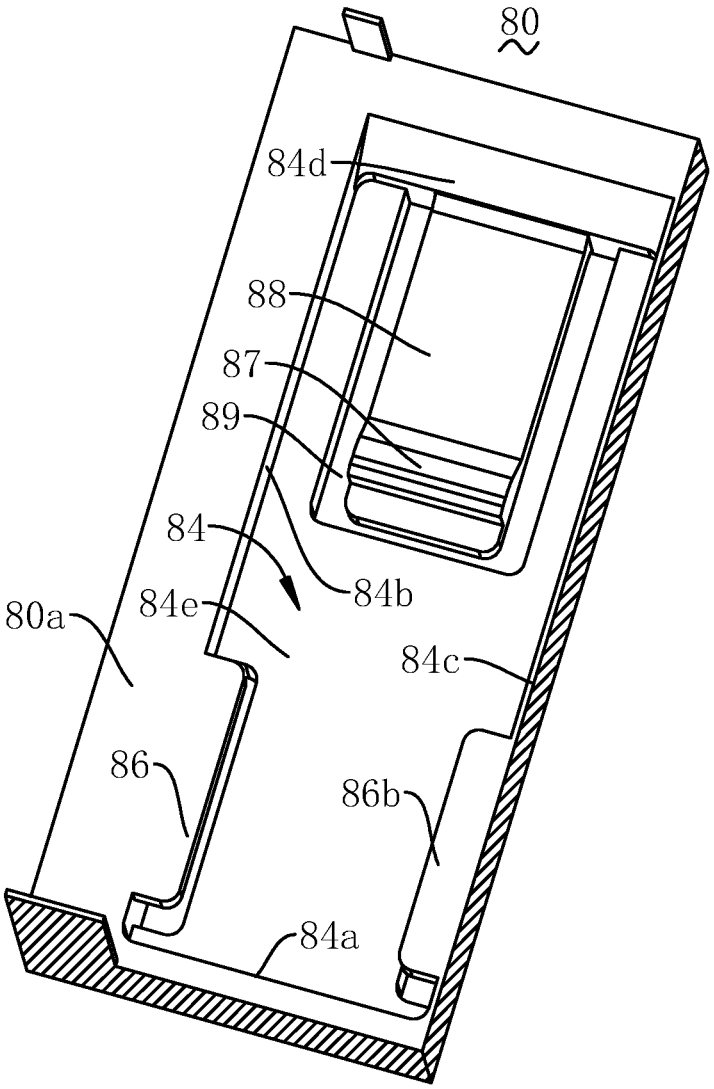
FIG. 13 is a stereoscopic partial sectional view of the support frame shown in FIG. 12.

With reference to FIG. 13 together, to firmly support the electrical connector 101 (or 101*b*), the support frame 80 has a mounting groove 84. Specifically, the mounting groove 84 is provided on an upper surface 80*a* of the support frame 80. The mounting groove 84 is only required for accommodating the retainer 50. The support frame 80 comprises a groove front end wall 84*a*, a groove rear end wall 84*d*, a pair of groove side walls 84*b*, 84*c*, and a groove bottom wall 84*e*. The groove front end wall 84*a*, the groove rear end wall 84*d*, and the pair of groove side walls 84*b*, 84*c* enclose the mounting groove 84. The number and specific distribution of the mounting grooves 84 may be selected according to application needs.

To further enable the electrical connector 101 to be firmly provided on the support frame 80, a backstop arm 86 is protrudingly provided on one or two of the groove sidewalls 84*b*, 84*c*. In this embodiment, a pair of the backstop arms 86, 86*b* are oppositely (i.e., facing each other) and protrudingly provided. The backstop arm 86 may be block-fitted with the retainer 50 in a depth direction of the mounting groove 84. The pair of groove sidewalls 84*b*, 84*c* and/or the backstop arm 86 may be deformed so that the retainer 50 may be received into the mounting groove 84. To facilitate mounting the retainer 50, a length of the mounting groove 84 is larger than that of the retaining body 50. Specifically, a distance between the groove rear end wall 84*b* and the backstop arm 86 is larger than or equal to that of the retainer 50. Specifically, the backstop arm 86 is arranged to be block-fitted with a limit part 52 of the retainer 50.

To further firmly retain the electrical connector 101, the support frame 80 further comprises a return-blocking portion 87. The return-blocking portion 87 is arranged in the mounting groove 84 and is arranged to protrude along a protruding direction of the second protruding end portion 32. The return-blocking portion 87 is spaced from the groove front end wall 84*a* to block and retain the retainer 50, respectively. When the retainer 50 is inserted into the mounting groove 84 and block-fitted with the backstop arm 86, the return-blocking portion 87 prevents the retainer 50 from reversing or loosing towards the inserting direction. To facilitate disassembling the retainer 50, the return-blocking portion 87 is arranged to be reciprocatively movable along the protruding direction of the second protruding end portion 32. The return-blocking portion 87 may be an elastically deformable structure to be arranged to be reciprocatively movable. In this embodiment, the return-blocking portion 87 is protrudingly arranged on a supporting cantilever 88 as will be described infra.

To simplify the configuration of the return-blocking portion 87 and to facilitate achieving the reciprocatively movable arrangement, the support frame 80 further comprises a supporting cantilever 88. The supporting cantilever 88 is arranged to continuously extend from the groove rear end wall 84*d*. The supporting cantilever 88 is arranged to be spaced from the mounting groove 84 to thereby provide space for a reciprocative movement. The supporting cantilever 88 is an elastically deformable structure to thereby enable a reciprocative movability.

In order to increase the space of the supporting cantilever 88 for the reciprocative movement without an increase in a thickness of the support frame 80, a vacating hole 89 is provided at a bottom portion 84*e* of the mounting groove 84. The vacating hole 89 is disposed to directly face the supporting cantilever 88 and may accommodate the supporting cantilever 88. To achieve larger space as quickly as possible, the vacating hole 89 is a through-hole.

To facilitate manufacturing of the support frame 80 and obtain firm mechanical strength, the support frame 80 is a whole unit. Specifically, the support frame 80 is an injection-molded unit. In this embodiment, the support frame 80 and the electrical connectors 101, 101*b* are separately and independently formed to prevent the electrical connectors 101, 101*b* from being injection-molded as inserts with the support frame 80 into a whole unit, which not only enhances the universal performance, but also reduces manufacturing complexity, prevents the support frame 80 from generating a larger stress and lowers the requirements on moulds and processes.

Figure 1:
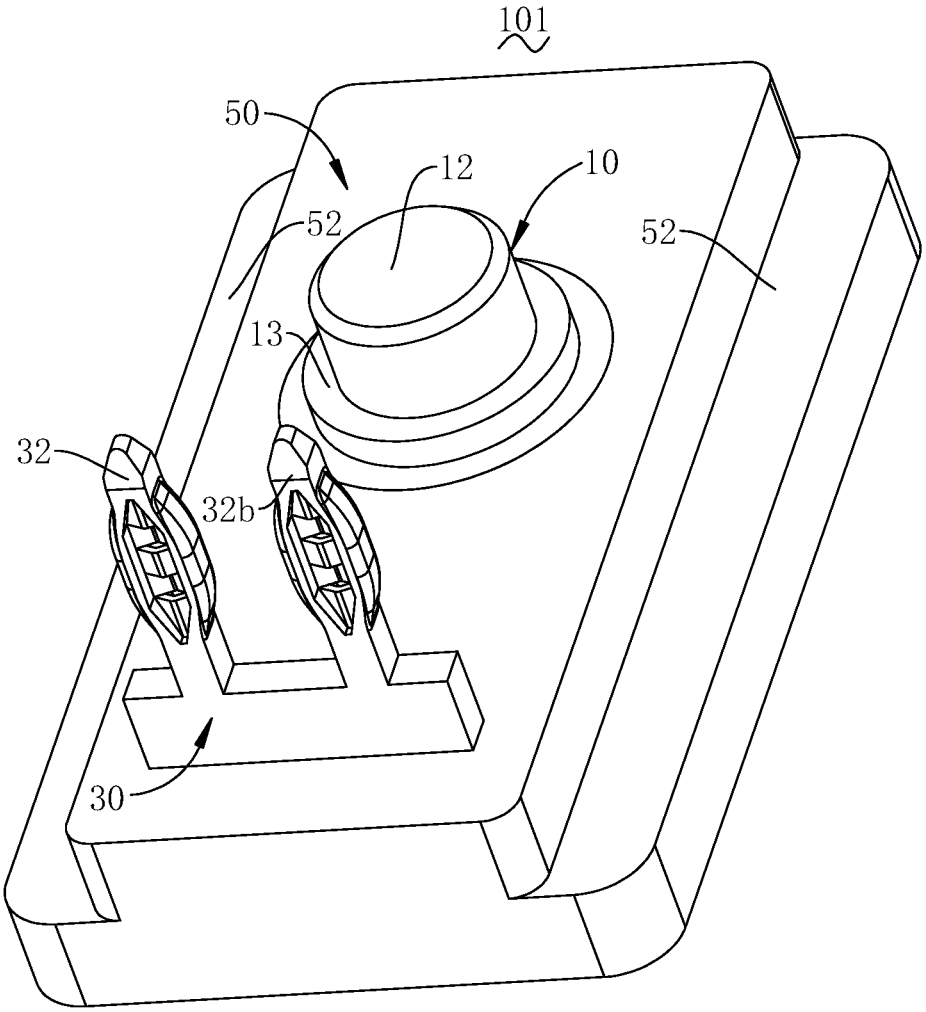
FIG. 1 is a structural schematic diagram of an embodiment of an electrical connector provided by the present disclosure.
Figure 2:
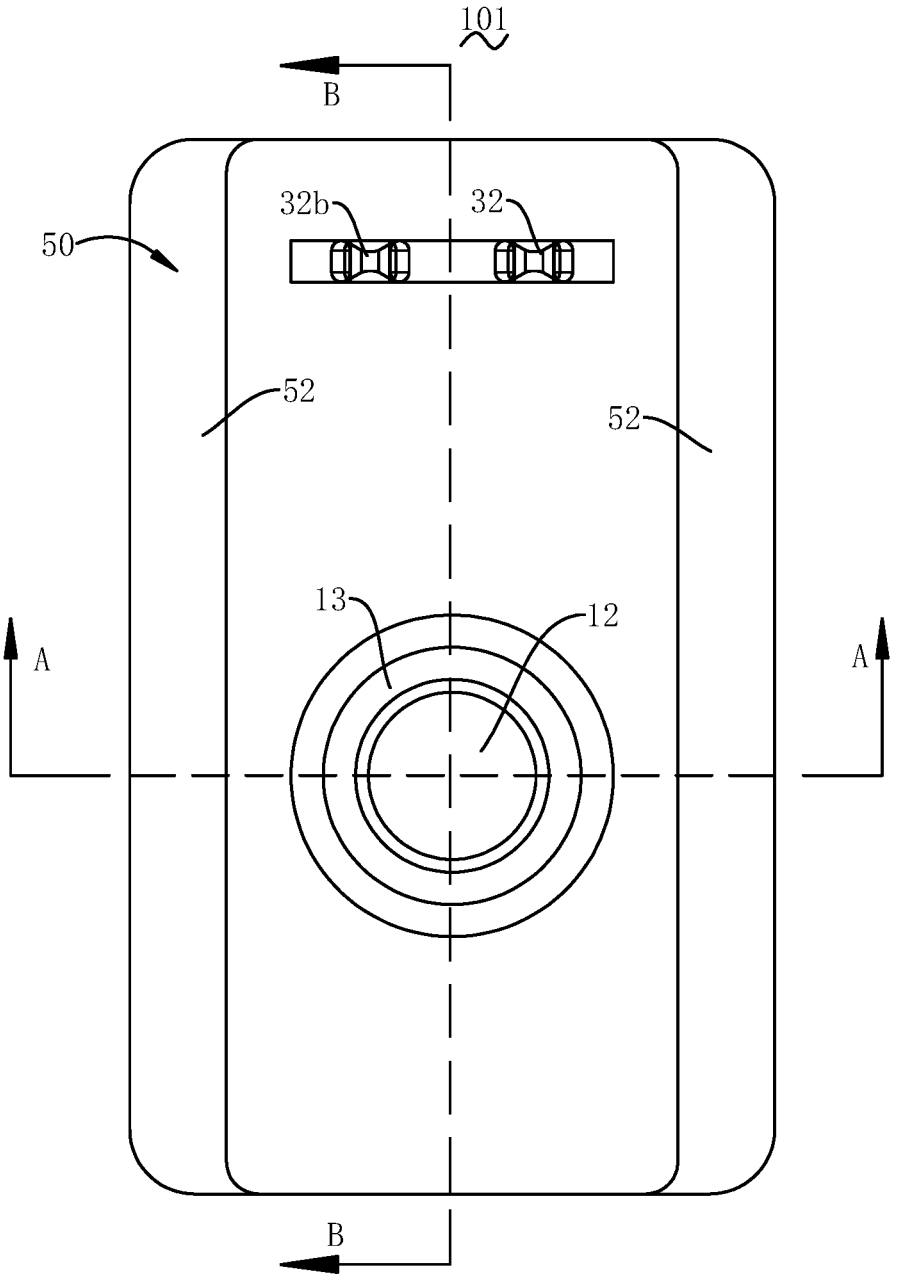
FIG. 2 is a projected view of the electrical connector of FIG. 1.
Figure 3:
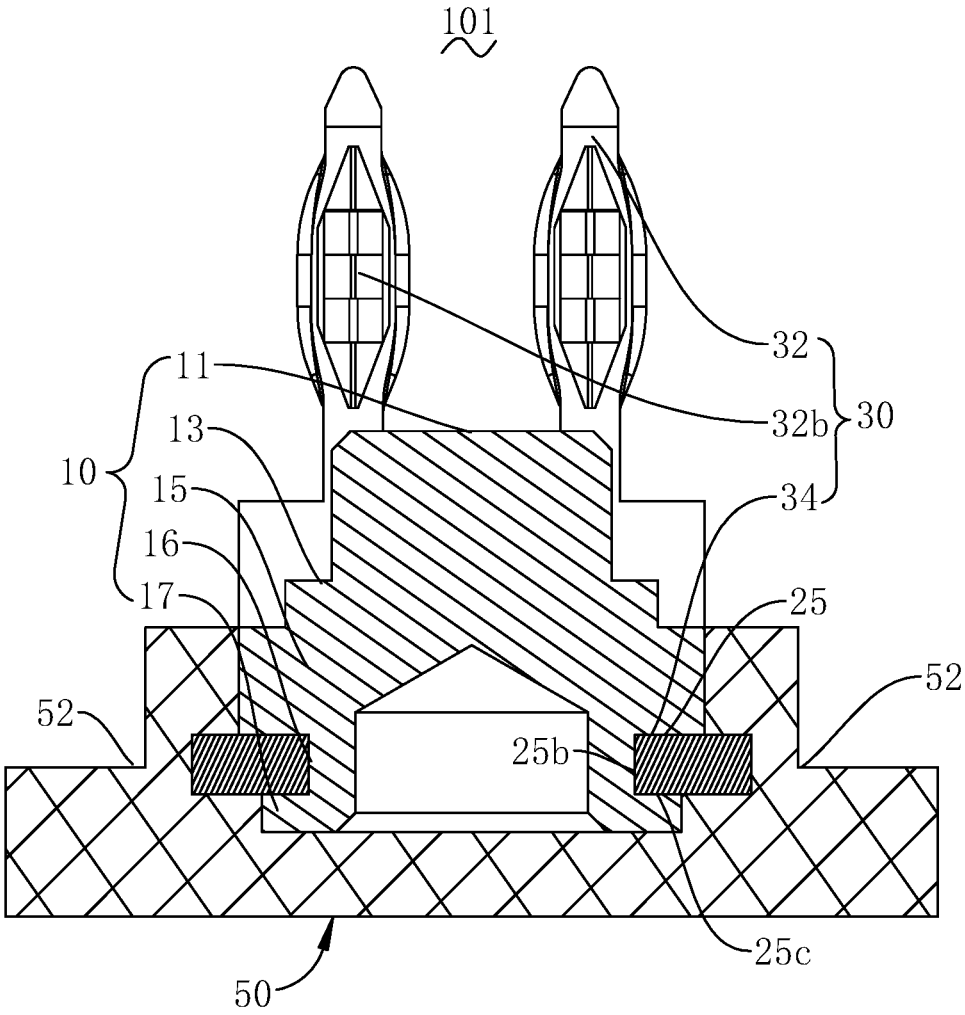
FIG. 3 is a sectional view of the electrical connector of FIG. 2 along line A-A.
Figure 4:
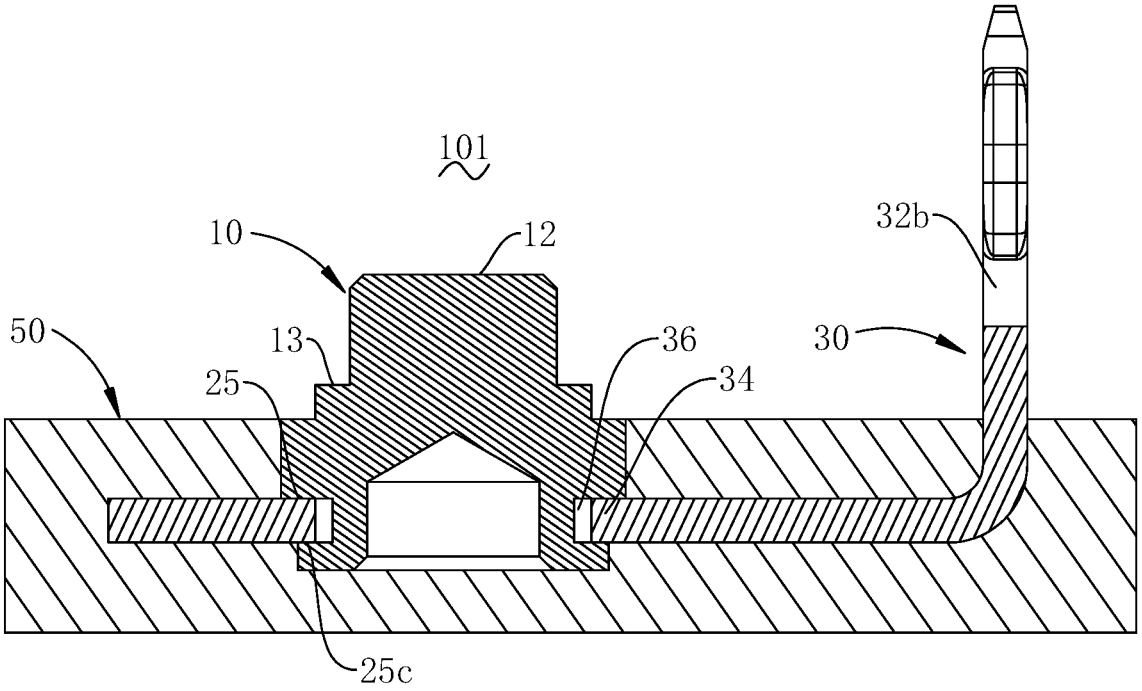
FIG. 4 is a sectional view of the electrical connector of FIG. 2 along line B-B.

To facilitate understanding the relative spatial positional relationships between various components, the present disclosure uses expressions which are opposite concepts to each other, such as "left-right," "front-rear," and "top-bottom" or the like, wherein the two sides in FIG. 2 indicate left and right, i.e., a transverse direction. Correspondingly, a longitudinal direction refers to the top-bottom direction in FIG. 2. The upper and lower surfaces of the second connecting portion 34 refer to the two surfaces in the top-bottom direction in FIG. 3 and FIG. 4.

What have been described above are only preferred embodiments of the present disclosure, which are not intended to limit the protection scope of the present disclosure. Any modifications, equivalent substitutions or improvements within the spirit of the present disclosure shall be included within the scope of the claims of the present disclosure.

What is claimed is:

1. An electrical connection assembly for electrically connecting any one of a plurality of battery cells in a battery pack to a circuit board, the electrical assembly comprising:

one or more electrical connector modules, each electrical connector module comprising:

a first connector comprising a first connecting portion and a first protruding end portion that are integrally connected with each other;

a second connector comprising a second connecting portion and a second protruding end portion that are integrally connected with each other, the second connecting portion being electrically connected to the first connecting portion; and a retainer integrally interconnected with the first connector and the second connector;

wherein the second connector and the first connector are independently and separately formed elements;

wherein the first protruding end portion is arranged to protrude from the retainer to electrically connect to a first mating connector; and wherein the second protruding end portion is arranged to protrude from the retainer to electrically connect to a second mating connector;

a support frame having a plurality of mounting grooves, each of the mounting grooves is configured to removably retain one of the one or more electrical connector modules;

wherein the one or more electrical connector modules are removably retained in the plurality of mounting grooves.

2. The electrical connection assembly according to claim 1, wherein:

the first mating connector and the second mating connector are provided on the support frame;

the first mating connector is electrically connected to the first protruding end portion of the first connector for electrically connecting to a battery cell; and the second mating connector is electrically connected to the second protruding end portion of the second connector.

3. The electrical connection assembly as recited in claim 1, further comprising a circuit board, wherein:

each of the plurality of mounting grooves is defined by a groove front end wall, groove side walls, a groove rear end wall, and a groove bottom wall;

the support frame further comprises a supporting cantilever, a free end of the supporting cantilever being provided with a return-blocking portion; and the return-blocking portion and the groove front end wall are arranged apart and to be block-fittable with the retainer, respectively.

4. The electrical connection assembly according to claim 3, wherein:

at least one of the groove side walls is provided with a backstop arm; and the backstop arm is configured to protrude and extend into the mounting groove and to be block-fittable with the retainer.

5. The electrical connection assembly according to claim 4, wherein:

one or two side walls of the retainer are provided with a blocking step; and the blocking step is configured to be block-fittable with the backstop arm.

6. The electrical connection assembly according to claim 4, wherein:

the groove front end wall and the groove rear end wall are arranged apart along a longitudinal direction of the retainer; and the distance between the groove rear end wall and the backstop arm is greater than or equal to a longitudinal length of the retainer.

7. The electrical connection assembly as recited in claim 1, further comprising a circuit board, wherein the second protruding end portions electrically connect to the circuit board.

* * * * *